United States Patent [19]

Steiner

[11] Patent Number: 4,659,247

[45] Date of Patent: Apr. 21, 1987

[54] EDGING ELEMENT WITH INTERLACEABLE ELASTIC ANCHORING STRIP

[75] Inventor: Alfred Steiner, Andelfingen, Switzerland

[73] Assignee: Steiner Silidur AG Andelfingen, Andelfingen, Switzerland

[21] Appl. No.: 783,543

[22] Filed: Oct. 3, 1985

[30] Foreign Application Priority Data

Nov. 9, 1984 [EP] European Pat. Off. ..... 84810543.3

[51] Int. Cl.[4] ..... E01C 13/00; E01C 5/22

[52] U.S. Cl. ..... 404/8; 404/68; 52/102; 52/309.17

[58] Field of Search ..... 404/7, 8, 37, 40, 47, 404/50, 51, 68, 69; 52/102, 179, 254, 309.17, 717.1, 718.1; 272/3, 4; 249/9

[56] References Cited

U.S. PATENT DOCUMENTS 875,025 12/1907 Whinery ..... 404/8

1,209,713 12/1916 Kane ..... 404/8

*Primary Examiner*—Stephen J. Novosad

*Assistant Examiner*—Matthew Smith

*Attorney, Agent, or Firm*—Benoit Law Corporation

[57] ABSTRACT

An edging element for playing fields and sports installations has an elongate elastic profile top and a strip for anchoring the edging element inside of the profile top in a concrete slab in interlacing relationship with a straight reinforcement rod. That anchoring strip extends along and projects from the elongate profile top and has a series of apertures distributed along at least one line parallel to the elongate profile top for receiving the reinforcement rod alternatively from different sides of the anchoring strip which is of sufficiently elastic material to form an interlacement with the straight reinforcement rod. The anchoring strip is made flat prior to its enlacement with the straight reinforcement rod but is interlaced with that straight reinforcement rod to have sections between successive apertures located alternatively at opposite sides of said straight reinforcement rod.

10 Claims, 1 Drawing Figure

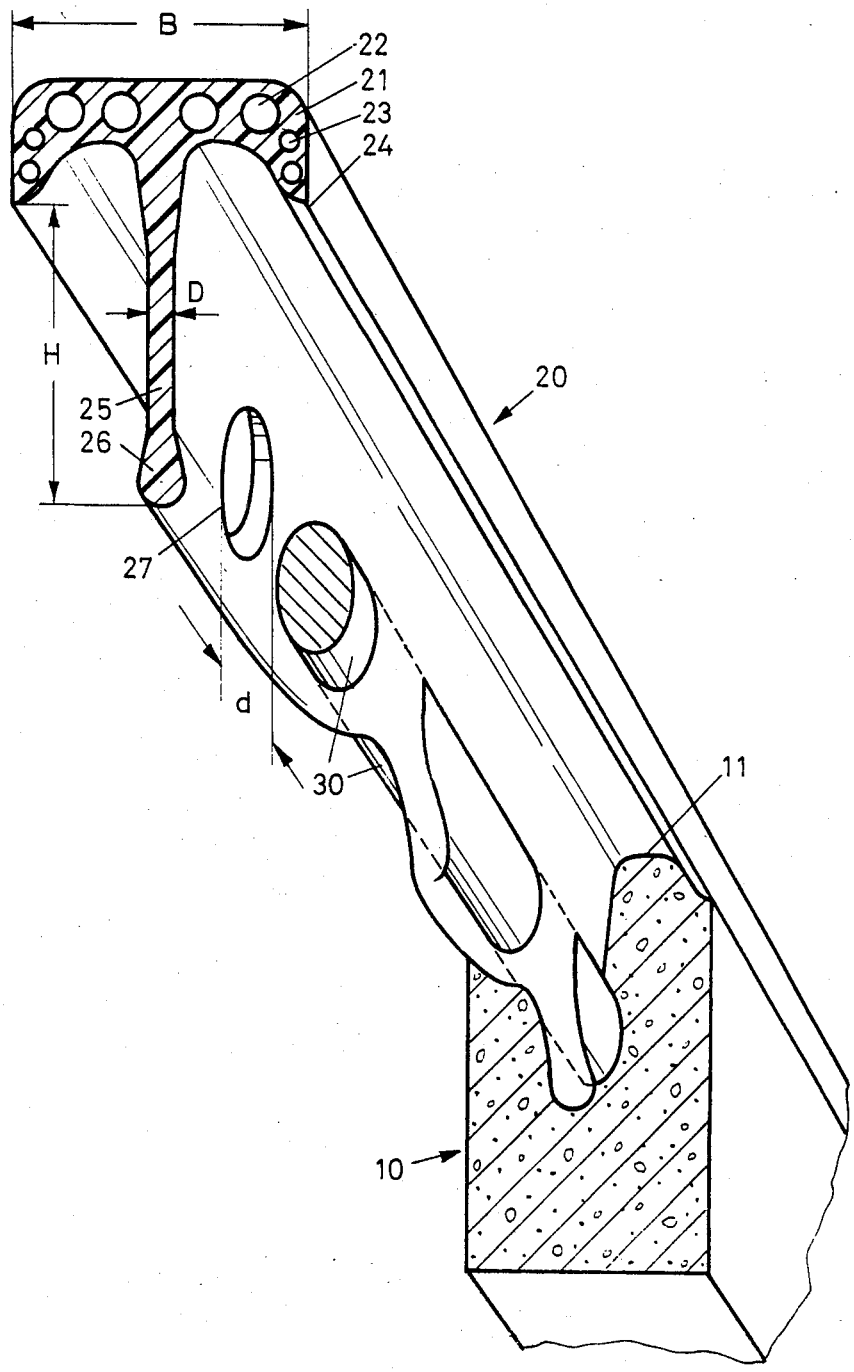
B
22
21
23
24
D
H
25
26
20
27
d
30
11
10

EDGING ELEMENT WITH INTERLACEABLE ELASTIC ANCHORING STRIP

BACKGROUND OF THE INVENTION

1. Field of the Invention

The subject invention relates to edging structures and, more specifically, to edging elements for playing fields and sports installations and for methods of making such edging elements.

2. Information Disclosure Statement

The following disclosure statement is made pursuant to the duty of disclosure imposed by law and formulated in 37 CFR 1.56(a). No representation is hereby made that information thus disclosed in fact constitutes prior art, inasmuch as 37 CFR 1.56(a) relies on a materiality concept which depends on uncertain and inevitably subjective elements of substantial likelihood and reasonableness and inasmuch as a growing attitude appears to require citation of material which might lead to a discovery of pertinent material though not necessarily being of itself pertinent. Also, the following comments contain conclusions and observations which have only been drawn or become apparent after conception of the subject invention or which contrast the subject invention or its merits against the background of developments which may be subsequent in time or priority.

German DE-U No. 7 030 096 describes a cover for borders consisting of a molding shaped body of rubber or synthetic material whereby its cross-section increasingly thickens towards the pit. In order to mount this body to the concrete plate it is provided with two dovetail shaped extensions which provide the required stability in the hardened concrete. In order to improve the elasticity of this body, it is provided with several borings of different diameters arranged in longitudinal direction. With such covers it was shown that the cohesion/holding strength of the two extensions in the concrete was not as great as was expected and that the extensions can detach due to impacts such as striking shots in shotput activities or that the concrete can break away. An improvement with regard to this disadvantage was to be effected by the German DE-C No. 2 350 099. Hereby the rubber profile was to be placed onto the concrete plate only, whereby a dove-tail shaped extension was provided on the concrete part and correspondingly, the flange at the rubber profile. Although an improvement resulted with regard to the breaking out of concrete, no improvement with regard to the mounting was effected.

Another mounting system was provided in German DE-U No. 7 410 473 which is also shown in the German DE-U No. 7 827 601. The rubber profile is provided with a widening ledge that was embedded into the wet concrete. Although this ledge can form a good mounting in massive concrete bodies such as drainage channels, there are reasonable doubts regarding its usefulness when such a widening ledge is embedded in the frontal area of a concrete plate, because the concrete can easily break away in the fringe areas next to this ledge.

British Patent specification No. 650,674, by G. S. Marston, discloses marking means for tennis courts, roadways and the like, being essentially T-shaped or H-shaped in cross-section, and having slots for providing increased holding by the material of the court. French Pat. No. 2 436 329 (79 22811) by Harald Mortsiefer et al, discloses hollow edgings profiles for sports installations, in which a thickened bead of a longitudinally extending and projecting strip is anchored in concrete. U.S. Pat. No. 1,896,641, by J. R. O'Brien, discloses road markers in which a web or depending portion has openings therethrough and anchors inserted therein for embedment in the pavement. Reference may also be had to my earlier U.S. Pat. No. 4,336,932, issued June 29, 1982 to the common assignee hereof, for Edging for the Track Inside of a Sports Installation, and to the U.S. and foreign patent documents cited therein.

SUMMARY OF THE INVENTION

It is a general object of this invention to overcome the disadvantages and to meet the needs expressed or implicit in the above Information Disclosure Statement or in other parts hereof.

It is a germane object of the invention to provide improved edging elements for playing fields and sports installations.

It is a related object of this invention to provide improved methods for making edging elements and to provide edging elements made by these methods.

It is also an object of this invention to mount an elastic covering ledge or profile top on the frontal area of a concrete plate in upright position to be used as an enclosure without weakening the concrete in the fringe areas to the extent that it would tend to break away.

It is a related object of this invention to provide robust edge stripping for all sports and for high demand areas, including pits for gymnastic apparatus and shotput, fields for hammer throwing, jumping and other field events, and borders of running tracks.

Other objects of the invention will become apparent in the further course of this disclosure.

From a first aspect thereof, the invention resides in an edging element for playing fields and sports installations, comprising, in combination, an elongate elastic profile top and means for anchoring that edging element inside of the profile top in a concrete slab in interlacing relationship with a straight reinforcement rod, comprising an anchoring strip extending along and projecting from the elongate profile top; that anchoring strip having a series of apertures distributed along at least one line parallel to the elongate profile top for receiving the reinforcement rod alternatively from different sides of the anchoring strip being of sufficiently elastic material to form an interlacement with the straight reinforcement rod.

From a related aspect thereof, the invention resides in a method of making an edging element for playing fields and sports installations, and, more specifically, resides in the improvement comprising, in combination, the steps of providing an elongate elastic profile top and an anchoring strip extending along and projecting from that elongate profile top for anchoring the edging element inside of the profile top in a concrete slab in interlacing relationship with a straight reinforcement rod, providing the anchoring strip with a series of apertures distributed along at least one line parallel to the elongate profile top for receiving the reinforcement rod alternatively from different sides of the anchoring strip, and making the anchoring strip of sufficiently elastic material to enable the anchoring rod to form an interlacement with the straight reinforcement rod.

BRIEF DESCRIPTION OF THE DRAWINGS

The subject invention and its various aspects and objects will become more readily apparent from the following detailed description of a preferred embodiment thereof, illustrated by way of example in the accompanying drawing which is a perspective view, partially in section and broken off, of an edging element according to a preferred embodiment of the invention.

DESCRIPTION OF THE PREFERRED EMBODIMENT

The concrete body 10, for instance a rectangular thin concrete plate or slab that is to be installed in upright position for a pit border, is covered on its frontal area or top 11 with a profile ledge 20 which, for example, is made of caoutchouc or an elastomer. As can be determined from the cross section of this profile ledge 20, it consists of a head part or elongate elastic profile top 21 and an anchoring rib or strip 25. The head part 21 is provided with longitudinally extending round channels 22, 23 of different diameters. As previously stated in the cited German DE-U No. 7 030 096, by precisely determining the location/placement and diameter, in conjunction with the properties of the materials, these channels have the task of providing the head part 21 with the stability and elasticity in accordance with its purpose. Furthermore, this also permits a saving of material. Although the diameters of these channels are shown as full circles for reasons of simplicity, other forms, in accordance with the expertise of the manufacturer of such ledges, are thinkable. Furthermore, a filling with soft foam materials could certainly be beneficial under certain circumstances.

The anchoring rib or strip 25 is formed flat and extends centrally over the border edges 24 of the head part for a depth or height H, which approximately corresponds to the width B of the head part. In this exemplified embodiment, the thickness D of the anchor rib 25 is approximately one twelfth of the width of the head part. The free end of the anchor rib 25 is provided with a thickening 26 by which the anchor rib 25 is thickened to twice the thickness D. That thickening is in the form of an elongate bead extending along a free edge of the anchoring strip.

Above this thickening 26, the anchor rib 25 is provided with a series of holes or apertures 27 which are arranged in a straight line parallel to the head part 21. The diameter d of these holes 27, which may be circular as shown, corresponds to approximately the half of the height H of the anchor rib 25. The apertures 27 are located in the anchoring strip 25 between the elongate profile top 21 and the free edge or elongate bead 26. Preferably, the apertures 27 are regularly spaced from each other.

As shown, a concrete reinforcement rod 30 is pushed through the holes 27 in such a manner, that it alternatingly penetrates the holes 27 from a different one of the two sides.

This causes a somewhat waved shape of the anchor rib 25 and the transverse regions of the rib 25 in the concrete body 10 are short and alternate with longer regions of the rib 25 in longitudinal direction or broad parts. The reinforcing rod 30 adheres to the concrete and, in addition to the known increased stability of such a ferro-concrete union, provides a good anchor for the profile ledge 20.

The illustrated edging element for playing fields and sports installations thus includes means for anchoring the edging element 20 below or inside of the profile top 21 in a concrete slab 10 in the interlacing relationship with the straight reinforcement rod 30, comprising an anchoring strip 25 extending along and projecting from the elongate profile top 21. That anchoring strip 25 has a series of apertures 27 distributed along at least one line parallel to the elongate profile top 21 for receiving the reinforcement rod alternatively from different sides of the anchoring strip 25 which is of sufficiently elastic material to form an interlacement with the straight reinforcement rod 30.

In terms of method, the anchoring strip is made of sufficiently elastic material to enable that anchoring strip 25 to form an interlacement with the straight reinforcement rod 30.

The anchoring strip 25 is made flat prior to its enlacement with the straight reinforcement rod 30 but is of sufficiently elastic material to have sections between successive apertures located alternatively at opposite sides of said straight reinforcement rod 30. The anchoring strip thus is interlaced with the straight reinforcement rod 30 to have sections between successive apertures 27 located alternatively at opposite sides of the straight reinforcement rod 30, as seen from the drawing.

I claim:

1. Edging element for playing fields and sports installations, comprising in combination:

an elongate elastic profile top; and means for anchoring said edging element inside of said profile top in a concrete slab in interlacing relationship with a straight reinforcement rod, comprising an anchoring strip extending along and projecting from said elongate profile top, said anchoring strip having a series of apertures distributed along at least one line parallel to said elongate profile top for receiving said reinforcement rod alternatively from different sides of said anchoring strip being of sufficiently elastic material to form an interlacement with said straight reinforcement rod.

2. Edging element according to claim 1, wherein:

said anchoring strip has a thickening in the form of an elongate bead extending along a free edge thereof.

3. Edging element according to claim 2, wherein:

said apertures are located in said anchoring strip between said elongate profile top and said elongate bead.

4. Edging element according to claim 3, wherein:

said apertures are regularly spaced from each other.

5. Edging element according to claim 4, wherein:

said anchoring strip is flat prior to its enlacement with said straight reinforcement rod but is of sufficiently elastic material to have sections between successive apertures located alternatively at opposite sides of said straight reinforement rod.

6. Edging element according to claim 1, wherein:

said apertures are located in said anchoring strip between said elongate profile top and a free edge of said anchoring strip.

7. Edging element according to claim 6, wherein:

said apertures are regularly spaced from each other.

8. Edging element according to claim 7, wherein:

said anchoring strip is flat prior to its enlacement with said straight reinforcement rod but is of sufficiently elastic material to have sections between successive apertures located alternatively at opposite sides of said straight reinforcement rod.

9. Edging element according to claim 1, wherein: said apertures are regularly spaced from each other.

10. Edging element according to claim 1, wherein: said anchoring strip is flat prior to its enlacement with said straight reinforcement rod but is of sufficiently elastic material to have sections between successive apertures located alternatively at opposite sides of said straight reinforcement rod.

* * * * *